US011401764B2

(12) United States Patent
Howlett

(10) Patent No.: US 11,401,764 B2
(45) Date of Patent: Aug. 2, 2022

(54) DOWNHOLE SWIVEL TOOL

(71) Applicant: Sudelac Limited, Aberdeenshire (GB)

(72) Inventor: Paul Howlett, Aberdeenshire (GB)

(73) Assignee: Sudelac Limited, Aberdeenshire (GB)

( * ) Notice: Subject to any disclaimer, the term of this patent is extended or adjusted under 35 U.S.C. 154(b) by 0 days.

(21) Appl. No.: 16/473,367

(22) PCT Filed: Dec. 27, 2017

(86) PCT No.: PCT/GB2017/053896
§ 371 (c)(1),
(2) Date: Jun. 25, 2019

(87) PCT Pub. No.: WO2018/122558
PCT Pub. Date: Jul. 5, 2018

(65) Prior Publication Data

US 2020/0141202 A1 May 7, 2020

(30) Foreign Application Priority Data

Dec. 28, 2016 (GB) ..... 1622338

(51) Int. Cl.

| | |
|---|---|
| ***E21B 17/05*** | (2006.01) |
| ***E21B 31/00*** | (2006.01) |
| ***E21B 17/07*** | (2006.01) |
| ***E21B 43/10*** | (2006.01) |

(52) U.S. Cl.
CPC ..... *E21B 31/005* (2013.01); *E21B 17/05* (2013.01); *E21B 17/073* (2013.01); *E21B 43/10* (2013.01)

(58) Field of Classification Search
CPC ..... E21B 17/05; E21B 17/073; E21B 43/10; E21B 43/103; E21B 31/005
See application file for complete search history.

(56) References Cited

U.S. PATENT DOCUMENTS 5,139,090 A * 8/1992 Land ..... E21B 23/01 166/117.7
5,642,782 A * 7/1997 Grimshaw ..... E21B 17/04 166/237
5,697,449 A * 12/1997 Hennig ..... E21B 33/1294 166/382

(Continued)

FOREIGN PATENT DOCUMENTS

| | | |
|---|---|---|
| WO | 2006109090 | 10/2006 |
| WO | 2015/161993 A2 | 10/2015 |
| WO | 2016/083582 A1 | 6/2016 |

OTHER PUBLICATIONS

International Search Report and Written Opinion for PCT/GB2017/053896 dated Mar. 21, 2018.

*Primary Examiner* — Cathleen R Hutchins
*Assistant Examiner* — Ronald R Runyan
(74) *Attorney, Agent, or Firm* — Workman Nydegger

(57) ABSTRACT

The invention provides a swivel tool for use in a wellbore. The tool comprises a tool body and a mandrel which is axially moveable relative to the tool body. The tool also comprises a lock member moveable between a first condition in which the mandrel is rotatably movable relative to tool body and a second condition in which the mandrel and a tool body are rotationally coupled. The lock member is configured to move between the first condition and second condition in response to a mechanical axial force and rotational force on the mandrel.

24 Claims, 2 Drawing Sheets

(56) References Cited

U.S. PATENT DOCUMENTS

| | | | | |
|---|---|---|---|---|
| 8,511,392 | B2 | 8/2013 | Howlett et al. | |
| 2004/0094309 | A1 | 5/2004 | Maguire | |
| 2007/0246217 | A1* | 10/2007 | Tulloch | E21B 23/006 166/311 |
| 2008/0236841 | A1* | 10/2008 | Howlett | E21B 17/05 166/381 |
| 2009/0114400 | A1 | 5/2009 | Obrejanu | |
| 2016/0326812 | A1 | 11/2016 | Hanton et al. | |

* cited by examiner

DOWNHOLE SWIVEL TOOL

CROSS-REFERENCE TO RELATED APPLICATIONS

The present application is a 35 U.S.C. § 371 U.S. National Stage of International Application No. PCT/GB2017/053896, filed on Dec. 27, 2017, which claims priority to Great Britain Patent Application No. 1622338.0, filed Dec. 28, 2016, the entire content of each of which is incorporated herein by reference.

The present invention relates to downhole apparatus for use in the oil and gas industry and in particular to a downhole swivel tool for use in running downhole apparatus such as liners and sand screens into a wellbore.

BACKGROUND TO THE INVENTION

During the construction of an oil or gas well, a well is drilled to a desired depth. Liners or casing sections are attached to the downhole string and lowered to the deepest section the borehole in the well and cemented in place. This process of securing the liner or casing sections is repeated until the wellbore is lined.

Depending on the wellbore formation, sand control apparatus such as sand screens may be required to allow the ingress of reservoir fluid while preventing sand and debris entering the wellbore.

Wellbores may be vertical, horizontal or deviated bores and it can be difficult installing apparatus at the deepest sections of the wellbore due to static friction between the downhole string and the wellbore. This is a particular issue with horizontal, highly deviated and long reaching bores where it is necessary to rotate the downhole string during run-in to overcome static friction.

If a downhole string is not rotated during run-in there may be insufficient weight available to overcome the static friction and push the liner or sand screen to total depth (TD). However, rotating the liner and/or sand screen in the wellbore may cause damage to the liner or sand screen apparatus or their connections. It is desirable that the liner or sand screen apparatus is moved to TD without being rotated during run-in.

U.S. Pat. No. 8,511,392 discloses a swivel sub for connection in a work string between a drill string and a downhole apparatus. The swivel sub includes a sliding sleeve which is axially moveable between disengaged and engaged positions to control the transfer of rotational torque of the drill string to a downhole apparatus located below the swivel sub. A disadvantage of the tool disclosed in U.S. Pat. No. 8,511,392 is that a pressure differential is required to move the sliding sleeve between the disengaged and engaged positions.

SUMMARY OF THE INVENTION

It is an object of an aspect of the present invention to obviate or at least mitigate the foregoing disadvantages of prior art swivel subs and tools.

It is a further object of an aspect of the present invention to provide a robust and reliable, downhole swivel tool which may allow rotation of the downhole string above the tool whilst the liner and/or sand screen remains rotationally stationary during installation of the liner and/or screen in the wellbore.

It is another object of an aspect of the present invention to provide a downhole swivel tool which allows the selective rotational coupling of a drill string above the swivel tool and a downhole apparatus attached below the swivel tool without reliance on a pressure differential or hydraulic pressure.

Further aims of the invention will become apparent from the following description.

According to a first aspect of the invention there is provided a swivel tool for use in a wellbore comprising:

a tool body;

a mandrel which is axially moveable relative to the tool body;

and a lock member moveable between a first condition in which the mandrel is rotatably movable relative to the tool body and a second condition in which the mandrel and the tool body are rotationally coupled;

wherein the lock member is configured to move between the first condition and second condition in response to a mechanical axial force and rotational force on the swivel tool.

By providing a swivel tool capable of controlling the position or condition of the lock member by applying a mechanical axial force and rotational force on the mandrel it may facilitate controlled locking of the swivel tool without reliance on a pressure differential or hydraulic pressure.

The tool body may be connectable to a downhole apparatus. Preferably the swivel tool is connectable in a downhole string above the downhole apparatus such as a liner or sand screen apparatus. The tool body and/or mandrel may be connectable to the downhole string, which may be a drill string, tool string or work string.

Preferably the mechanical axial force is applied by providing tension or upward force on the mandrel. The mechanical axial force may be applied by providing tension or upward force on a downhole string connected to the mandrel. The rotational force or torque may be applied by rotating the mandrel and/or a downhole string connected to the mandrel. The rotational force may be applied to the mandrel whilst the mechanical axial force is applied to the mandrel.

By providing a swivel tool connectable to a drill string above a liner or sand screen apparatus, the swivel tool may allow rotation of the string above (upper string) the swivel tool but not the string below (lower string) the swivel tool. Rotational torque is not transmitted to the lower string, the liner or sand screen apparatus. This may facilitate the rotation of the upper string to overcome the friction between the string and the wellbore, and increased weight may be applied to push the string into the well without damaging the lower string.

The rotational force may be applied in a right-hand or left-hand direction. Right hand rotation is preferred.

Right hand rotation is preferred as running and pushing the downhole string and/or swivel tool in the wellbore is generally only practical by rotating to the right. However, the downhole string and/or swivel tool may alternatively be run and pushed in the wellbore by rotating to the left.

Preferably the lock member is configured to move between the first position or condition and second position or condition in response to tension and right-hand rotation of the mandrel.

Providing a swivel tool capable of being locked by mechanical manipulation of the mandrel or a downhole string connected to the mandrel the tool may facilitate reliable locking of the tool without relying on hydraulically activated systems, which may require a ball or dart landing on a seat to create a pressure differential.

By avoiding the use of hydraulic systems to lock the swivel tool, the internal diameter of the throughbore of the tool is not blocked or restricted by a ball or dart. This may allow the swivel tool to be controlled independently of hydraulically operated tools. It also mitigates the risk of accidental locking of the swivel tool during downhole operations using hydraulically operated tools.

The tool may comprise a bearing member located between an inner surface of the tool body and an outer surface of the mandrel. The bearing member may comprise a plurality of bearings. The bearing member may facilitate the rotation of the mandrel relative to the tool body, which may allow the downhole string when attached to the mandrel to be rotated to overcome static friction, whilst a downhole assembly when attached to the tool body does not rotate to avoid damage.

The tool body may have a recess section on its inner surface. The recess section may be shaped and/or may be dimensioned to receive a lock member. The recess section may be a hex-shaped recess and/or the lock member may have a corresponding hex shape configured to engage the hex recess section.

The lock member may be configured to move into the recess section in response to a mechanical axial force on the mandrel.

The mandrel may comprise threads formed on a section of its outer surface. The lock member may have a threaded bore which may be configured to be threadably mounted on the mandrel. The threads on the mandrel may be configured to engage the threaded bore of the lock member. The threads on the mandrel may be configured to engage the threaded bore of the lock member when a mechanical axial force and rotational force is applied to the mandrel. The mandrel may be configured to be rotated to move the lock member axially along the mandrel surface. The mandrel may be configured to be rotated under tension to move the lock member axially along the mandrel surface.

The tool may comprise a dog assembly. The dog assembly may be located in or as part of the locking member. The locking dog assembly may comprise a latch member. The latch member may be biased towards the outer surface of the mandrel by springs.

The mandrel may comprise a latch recess on its outer surface. The latch recess may be shaped and dimensioned to receive the latch member. The latch recess and latch member may have a non-uniform shape such that the latch member may be fully received in the recess before the locking dog assembly latches. The recess and the latch member may be a tapered hexagonal prism shape such as a coffin-shape.

The latch recess and the latch member may be configured to prevent axial movement of the mandrel relative to the tool body when the latch member is located in the latch recess. The latch recess and the latch member may be configured to rotationally couple the mandrel and the tool body.

The lock member may be configured to be latched in the second position to lock the mandrel and the tool body in a rotationally coupled configuration.

According to a second aspect of the invention there is provided a swivel tool for use in setting a liner in a wellbore, the swivel tool being connectable in a downhole string above a liner apparatus and comprising:

a tool body;

a mandrel, wherein the mandrel is axially moveable relative to the tool body;

and a lock member moveable between a first position in which the mandrel is rotatably movable relative to the tool body and a second position in which the mandrel and the tool body are rotationally coupled;

wherein the lock member is configured to move between the first position and second position in response to a mechanical axial force and rotational force applied to the swivel tool.

By providing a swivel tool capable of controlling the position of the lock member by applying a mechanical axial force and rotational force to the mandrel it may facilitate selective rotation of the tool body. This may mitigate uncontrolled rotation of a downhole apparatus during positioning in the wellbore.

The swivel tool and connected liner apparatus may be advanced through a wellbore while the lock member is in a first position such that the downhole string is free to rotate whilst the tool body and connected liner apparatus are not rotated.

Preferably the mechanical axial force is applied by providing tension or upward force on the mandrel. The mechanical axial force may be applied by providing tension or upward force on a downhole string connected to the mandrel. The rotational force may be applied by rotating the mandrel and/or a downhole string connected to the mandrel. The rotational force may be applied to the mandrel whilst the mechanical axial force is applied to the mandrel.

The mechanical axial force on the mandrel may be applied by providing an axial force above a pre-set threshold on the downhole string.

The lock member may be configured to be latched in the second position to lock the mandrel and the tool body in a rotationally coupled configuration.

Embodiments of the second aspect of the invention may include one or more features of the first aspect of the invention or its embodiments, or vice versa.

According to a third aspect of the invention there is provided a swivel tool for use in setting a sand screen in a wellbore, the swivel tool being connectable in a downhole string above the sand screen apparatus and comprising:

a tool body;

a mandrel, wherein the mandrel is axially moveable relative to the tool body;

and a lock member moveable between a first position in which the mandrel is rotatably movable relative to the tool body and a second position in which the mandrel and the tool body are rotationally coupled;

wherein the lock member is configured to move between the first position and second position in response to a mechanical axial force and rotational force applied to the swivel tool.

The swivel tool and connected screen apparatus may be advanced through a wellbore while the lock member is in a first position such that the downhole string is free to rotate whilst the tool body and connected screen apparatus are not rotated.

Preferably the mechanical axial force is applied by providing tension or upward force on the mandrel. The mechanical axial force may be applied by providing tension or upward force on the downhole string when connected to the mandrel. The rotational force may be applied by rotating the mandrel and/or a downhole string connected to the mandrel. The rotational force may be applied to the mandrel whilst the mechanical axial force is applied to the mandrel.

Embodiments of the third aspect of the invention may include one or more features of the first or second aspects of the invention or their embodiments, or vice versa.

According to a fourth aspect of the invention there is provided a system for setting a liner and/or a sand screen in a wellbore, the system comprising a downhole string, a liner and/or a sand screen and a swivel tool;

wherein the swivel tool is connected in the downhole string above the liner and/or sand screen, and the swivel tool comprises:

a tool body;

a mandrel axially moveable relative to the tool body;

and a lock member moveable between a first position in which the mandrel is rotatably movable relative to the tool body and a second position in which the mandrel and the tool body are rotationally coupled;

wherein the lock member is configured to move between the first position and second position in response to a mechanical axial force and rotational force applied to the swivel tool.

Preferably the mechanical axial force is applied by providing tension or upward force on the swivel tool. The mechanical axial force may be applied by providing tension or upward force on the downhole string.

Preferably the tool body is connected to the liner and/or a sand screen apparatus above the liner and/or sand screen apparatus.

Embodiments of the fourth aspect of the invention may include one or more features of the first to third aspects of the invention or their embodiments, or vice versa.

According to a fifth aspect of the invention there is provided a swivel tool on a drill string, the drill string connected to a sand screen or liner apparatus, wherein the swivel tool is located in the drill string above the sand screen or liner apparatus and comprises:

a tool body;

a mandrel axially moveable relative to the tool body;

and a lock member moveable between a first position in which the mandrel is rotatably movable relative to the tool body and a second position in which the mandrel and the tool body are rotationally coupled;

wherein the lock member is configured to move between the first position and second position in response to a mechanical axial force and rotational force applied to the swivel tool.

Embodiments of the fifth aspect of the invention may include one or more features of the first to fourth aspects of the invention or their embodiments, or vice versa.

According to a sixth aspect of the invention there is provided a method of running a downhole apparatus into a wellbore, the method comprising:

providing a downhole string connected to a downhole apparatus;

providing a swivel tool on the downhole string above the downhole apparatus, the swivel tool comprising a tool body, a mandrel, and a lock member;

running the downhole string, swivel tool and downhole apparatus into the wellbore, while the lock member is in a first condition and the swivel is operational to enable rotation of the mandrel relative to the tool body;

applying a mechanical axial force to the downhole string to engage the lock member and rotationally lock the swivel tool; and rotating the downhole string and the downhole apparatus in the wellbore.

The method may comprise rotating the downhole string with the lock member in a first condition in which the mandrel is rotatably movable relative to tool body such that downhole string rotates but the downhole apparatus is not rotated.

The method may comprise running the downhole string, swivel tool and liner into the wellbore while rotating the downhole string and the mandrel. The method may comprise rotating the downhole string relative to the downhole apparatus.

The method may comprise applying a mechanical axial force to the downhole string to axially move the mandrel relative to the tool body. The method may comprise applying a mechanical axial force to the downhole string to move the lock member between a first condition in which the mandrel is rotatably movable relative to tool body and a second condition in which the mandrel and a tool body are rotationally locked or coupled.

The method may comprise applying a mechanical axial force to the downhole string by providing tension or an upward force on the downhole string. The mechanical axial force may be applied to the downhole string by providing a pulling force on the downhole string from surface.

The method may comprise applying a mechanical axial force and rotational force to the downhole string to move the lock member between a first condition in which the mandrel is rotatably movable relative to tool body and a second position in which the mandrel and a tool body are rotationally coupled.

The method may comprise moving the lock member into a recess section in the tool body in response to a mechanical axial force on the mandrel. The recess section may be a hex-shaped recess and/or the lock member may have a corresponding hex shape configured to engage the hex recess section.

The method may comprise rotating the mandrel under tension to engage a threaded bore of the lock member. The method may comprise moving the lock member axially along the mandrel, for example along a mandrel surface. The method may comprise moving the lock member axially along the mandrel to the second position.

The method may comprise rotating the mandrel under tension in a first direction to engage a threaded bore of the lock member and move the lock member axially along the mandrel towards the lock member second position. The method may comprise rotating the mandrel under tension in a second direction to move the lock member axially along the mandrel toward the lock member first position and disengage the threaded bore of the lock member.

The method may comprise rotating the mandrel ten to fifty times under tension in a first direction to engage a threaded bore of the lock member and move the lock member axially along the mandrel surface towards the lock member second position. The method may comprise rotating the mandrel approximately twenty five times under tension in a first direction.

Preferably the first direction is a right-hand direction. Alternatively, the first direction is a left-hand direction.

The method may comprise latching the lock member at the second position. The method may comprise latching the lock member at the second position to lock the mandrel and a tool body in a rotationally coupled configuration.

The method may comprise rotating the downhole string with the lock member in a second position in which the mandrel and a tool body are rotationally coupled such that rotation of the downhole string rotates the downhole apparatus.

The method may comprise pumping fluid through a throughbore of the swivel tool to control the actuation or setting of a downhole apparatus or tool on the downhole string.

In a particular preferred embodiment of the method, the tool is operated as a swivel when in compression. The tool is unlocked when run in the hole. Weight can be applied through the tool in compression and it will swivel and allow the pushing force to be applied from a drill string above it and applied to the liner/screens below it. At any time, the operator can pull the string into tension, and the tool will stroke to an upper position at which a hex OD locking section is received inside a hex ID section of the body. With rotation (preferably right hand rotation), the locking assembly works its way up threads on the mandrel until locking dogs are lined up with the recesses on the mandrel. The locking dogs are pushed in by springs to rotationally look the tool. Typically, it would take around twenty-five turns whilst in tension to lock the tool. The tool does not lock by tension alone; in fact, it can stroke up and down as many times as is needed but only tension and rotation will lock it. Right hand rotation to lock the tool is preferred.

In preferred embodiments, the swivel tool is contained within the work string, most preferably towards its lower end. The majority of the work string is located above it, with very little work string positioned below it. However, it does not need to be directly above the liner, and may not be connected directly to the liner. Instead it may be connected within the work string, with the work string is connected to the liner. For example, there might be a 1 to 3 metres or several hundreds of metres of work string between the liner/screens and the swivel. When at total depth there may be 1000's of metres of work string above it.

When the swivel is first placed in the well with the liner below, it the tool will be in tension and stroked out because the weight below is more than the weight above. As the tool travels into the well and the liner reaches a high angle or horizontal section of the well, the drag from below will cause the tool to compress and stroke closed and the work string from above will be used to push the liner into the well. The tool may stroke open and closed sometimes at some points, but as the drag increases it will stay stroked closed when running in. When required, rotation can be employed to make more weight available to push with, then when required the work string can be picked up to deliberately to get tension in the tool so it can be locked. Once locked the whole string could be rotated to the right or to the left in compression or in tension.

Only a small amount of tension at the tool will typically be required to stroke it; it is able to rotate with small and medium amounts of tension at the tool to lock it (for example hundreds of pounds force or thousands of pounds force of tension), but too much tension may create too much friction for the threads to move.

In some modes of operation, the tool can be locked before total depth is reached, and we the whole string could be rotated to total depeth, or locked at total depth before the hanger/packer for a liner hanger is set. Alternatively, a hanger or packer could be set hydraulically prior to locking the swivel.

Embodiments of the sixth aspect of the invention may include one or more features of the first to fifth aspects of the invention or their embodiments, or vice versa.

According to a seventh aspect of the invention there is provided a method of running a liner into a wellbore, the method comprising:

providing a downhole string connected to a liner;

providing a swivel tool on the downhole string above the liner, the swivel tool comprising a tool body, a mandrel, and a lock member;

running the downhole string, swivel tool and liner into the wellbore, while the lock member is in a first condition and the swivel is operational to enable rotation of the mandrel relative to the tool body;

applying a mechanical axial force to the downhole string to engage the lock member and rotationally lock the swivel tool; and rotating the downhole string and the liner in the wellbore.

Embodiments of the seventh aspect of the invention may include one or more features of the first to sixth aspects of the invention or their embodiments, or vice versa.

According to an eighth aspect of the invention there is provided a method of running a sand screen apparatus into a wellbore, the method comprising:

providing a downhole string connected to a sand screen apparatus;

providing a swivel tool on the downhole string above the sand screen apparatus, the swivel tool comprising a tool body, a mandrel, and a lock member;

running the downhole string, swivel tool and sand screen apparatus into the wellbore, while the lock member is in a first condition and the swivel is operational to enable rotation of the mandrel relative to the tool body;

applying a mechanical axial force to the downhole string to engage the lock member and rotationally lock the swivel tool; and rotating the downhole string and the sand screen apparatus in the wellbore.

Embodiments of the eighth aspect of the invention may include one or more features of the first to seventh aspects of the invention or their embodiments, or vice versa.

According to a further aspect of the invention there is provided a swivel tool for use in a wellbore comprising:

a tool body;

a mandrel axially moveable relative to the tool body;

and a locking mechanism;

wherein the swivel tool is operable to move between a first condition in which the mandrel is rotatably movable relative to the tool body and a second position in which the mandrel and the tool body are rotationally locked by the locking mechanism;

and wherein the swivel tool is operable to move between the first and second conditions by rotating the swivel tool while the swivel tool is under tension.

According to a further aspect of the invention there is provided a method of running a downhole apparatus into a wellbore, the method comprising:

providing a downhole string connected to a downhole apparatus;

providing a swivel tool on the downhole string above the downhole apparatus, the swivel tool comprising a tool body, a mandrel, and a locking mechanism running the downhole string, swivel tool and downhole apparatus into the wellbore, while the swivel tool is in a first condition which enables rotation of the mandrel relative to the tool body;

rotationally locking the swivel tool by rotating the swivel tool while the swivel tool is under tension; and running or rotating the downhole string and the downhole apparatus in the wellbore in the rotationally locked condition.

Embodiments of the further aspects of the invention may include one or more features of the first to eighth aspects of the invention or their embodiments, or vice versa.

BRIEF DESCRIPTION OF THE DRAWINGS

There will now be described, by way of example only, various embodiments of the invention with reference to the drawings, of which.

DETAILED DESCRIPTION OF PREFERRED EMBODIMENTS

The swivel tool is configured to be deployed on a drill string to run sand screens or liners into a wellbore. It will be appreciated that this is only an example use and the tool may be used in other applications.

Figure 1:
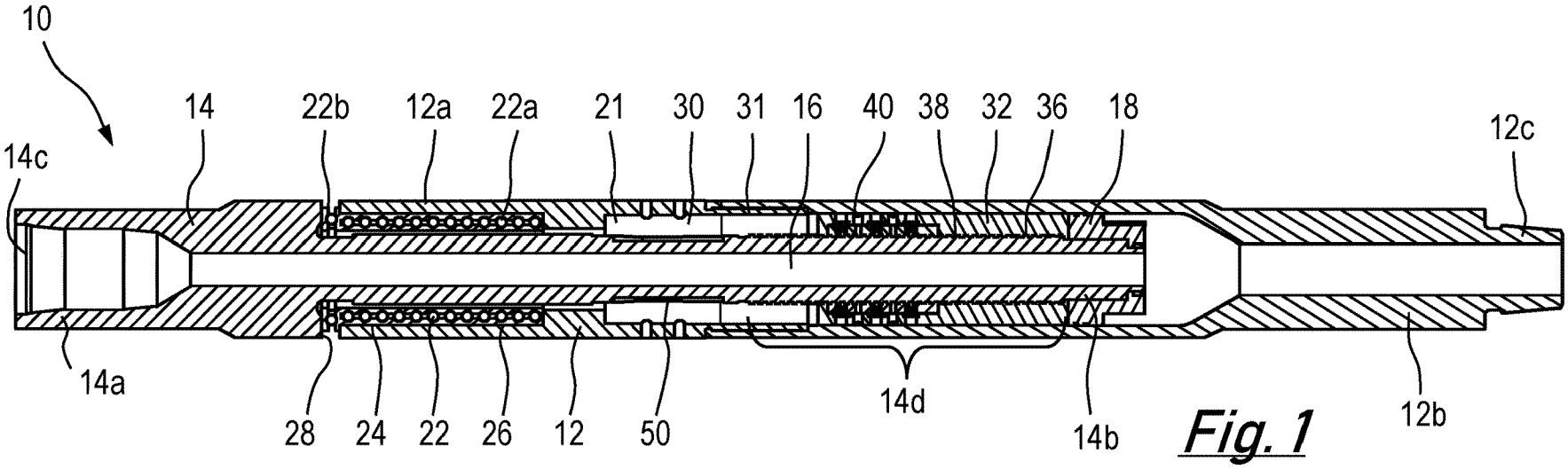
FIG. 1 is a sectional view through a swivel tool in an unlocked configuration according to a first embodiment of the invention during a run-in state.

FIG. 1 is a longitudinal sectional view of a swivel tool 10 in accordance with a first embodiment of the invention. The tool 10 has an elongate body 12 and a mandrel 14. The tool 10 has a throughbore 16.

A first end 14*a* of the mandrel 14 comprises a box section 14*c* which is configured to be coupled to an upper downhole string such as an upper drill string (not shown). A first end 12*a* of the body 12 surrounds a portion of the mandrel 14. The mandrel 14 is axially movably mounted in a bore 21 of the body 12.

On a second end 14*b* of the mandrel 14 a support member 18 is mounted. The support member 18 keeps the second end 14*b* of the mandrel 14 in the centre of the bore 21 of the body 12 to help ensure efficient axial movement of the mandrel.

The second end 12*b* of the body 12 comprises a pin section 12*c* configured to be coupled to a downhole string connected to a downhole tool apparatus such as a liner or sand screen apparatus (not shown). The second end 12*b* of the body is designed for insertion into a downhole tubular first. The tool is located towards the lower end of a downhole string. The downhole string between the tool and the downhole apparatus may be a few feet or several hundred feet in length.

The tool 10 comprises a bore 16 through which fluid is configured to be pumped to facilitate the hydraulic control of downhole tools and/or liner or sand screen apparatus located below the swivel tool on the downhole string.

The first end 12*a* of the body 12 has a bearing member 22 located between an inner surface 24 of the body 12 and an outer surface 26 of the mandrel. The bearing member 22 comprises a plurality of bearings 22*a*. The bearing member 22 has an end face 22*b* which abuts a shoulder 28 on the mandrel when in a run-in configuration shown in FIG. 1. The bearing member 22 facilitates the rotation of mandrel 14 relative to the tool body 12 while reducing friction and handling stresses.

The body 12 has a recess section 30 on its inner surface 31. The recess section 30 is shaped and dimensioned to receive a lock member 32. In the present example, the recess section 30 is a hex-shaped recess and the lock member 32 has a corresponding hex shape configured to engage the hex recess section 30. However, it will be appreciated that other shaped recesses and corresponding lock member shapes may be used.

A section 14*d* of the mandrel 14 has threads 36 formed on the outer surface. The lock member 32 has a threaded bore 38 and is configured to be threadably mounted on the mandrel. The threads 36 on the mandrel 14 engage the threaded bore 38 of the lock member 32.

Figure 4:
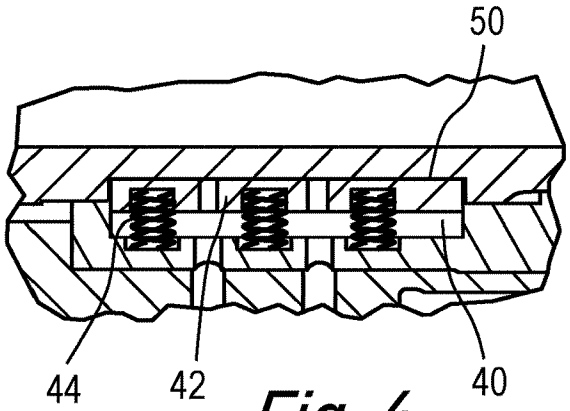
FIG. 4 is an enlarged view of portion "BA" of FIG. 3.

The locking member 32 comprises a locking dog assembly 40. The locking dog assembly 40 best seen in FIG. 4 has a latch member 42 which is biased towards the mandrel outer surface by springs 44.

The mandrel 14 has a recess 50 on its outer surface. The recess 50 is shaped and dimensioned to receive the latch member 42. The recess 50 and latch member 42 have a non-uniform shape such that the latch member 42 is fully received in the recess 50 before the locking dog assembly 40 latches. In the present example, the recess 50 and the latch member 42 have a tapered hexagonal prism shape such as coffin-shape. However, it will be appreciated that other shaped recesses and corresponding latch member shapes may be used.

Operation of the apparatus will now be described with reference to FIGS. 1 to 4. The swivel tool 10 is connected to a drill string (not shown) via the box section 14*c* at end 14*a* of the mandrel 14. A liner hanger apparatus or sand screen apparatus (not shown) is connected to the swivel tool at end 12*b*.

When the swivel tool is first placed in the well above the liner or sand screen apparatus, the swivel tool will be in tension and stroked out, because the weight below the swivel tool is more than the weight above the swivel tool. The mandrel may stroke open and closed as the tool travels into the well, but as the drag increases the mandrel will stay in a stroked closed when running in. In the run-in state shown in FIG. 1, as the tool travels into the well and the liner reaches a high angle or horizontal section of the well the drag will cause the tool to compress and the mandrel to stroke closed. The work string from above will be used to push the liner into the well.

In the run-in state shown in FIG. 1, the swivel tool 10 is in an unlocked position where the mandrel is under compression. The mandrel 14 is free to rotate relative to the tool body 12. In the unlocked configuration, the mandrel 14 is in a first mandrel position where the lock member 32 is axially spaced apart from the recess section 30 on the inner surface 31 of the tool body 12. As the mandrel 14 rotates the lock member 32 mounted on the mandrel rotates within the bore 21 of the tool body.

The end face 22*b* of the bearing member 22 abuts the shoulder 28 on the mandrel. As the mandrel 14 rotates relative to the tool body the torque is imparted to the bearing member 22 which reduces friction between the rotating mandrel 14 and the rotationally stationary tool body 12. Weight is applied to the rotating drill string to move the drill string, swivel tool and downhole apparatus through the wellbore. The rotating drill string overcomes the static friction between the drill string and the wellbore and the downhole apparatus is not rotated to prevent damage or unnecessary wear.

The drill string can continue to be rotated to facilitate its movement through the deviated well without imparting rotation on the liner or sand screen apparatus. The tool 10 operates as a swivel during downhole string compression during run-in.

Once the liner or screen apparatus has reached the desired depth in the wellbore it may be necessary to rotate the liner or screen apparatus to set the liner or screen apparatus and/or release the liner or screen apparatus from the swivel tool so that the downhole string can be pulled out of the wellbore leaving the set liner or sand screen in the wellbore. In order to rotate the liner or screen apparatus, the swivel tool is moved to a locked configuration as shown in FIGS. 2 and 3.

Figure 2:
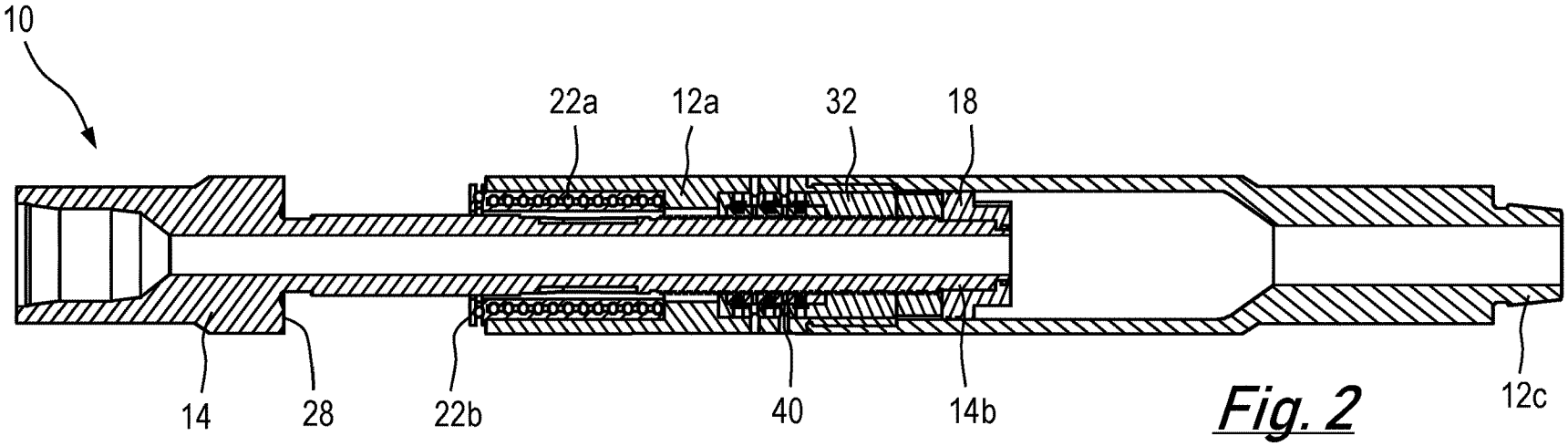
FIG. 2 is a sectional view through the swivel tool of FIG. 1 in a mandrel stroked position.
Figure 3:
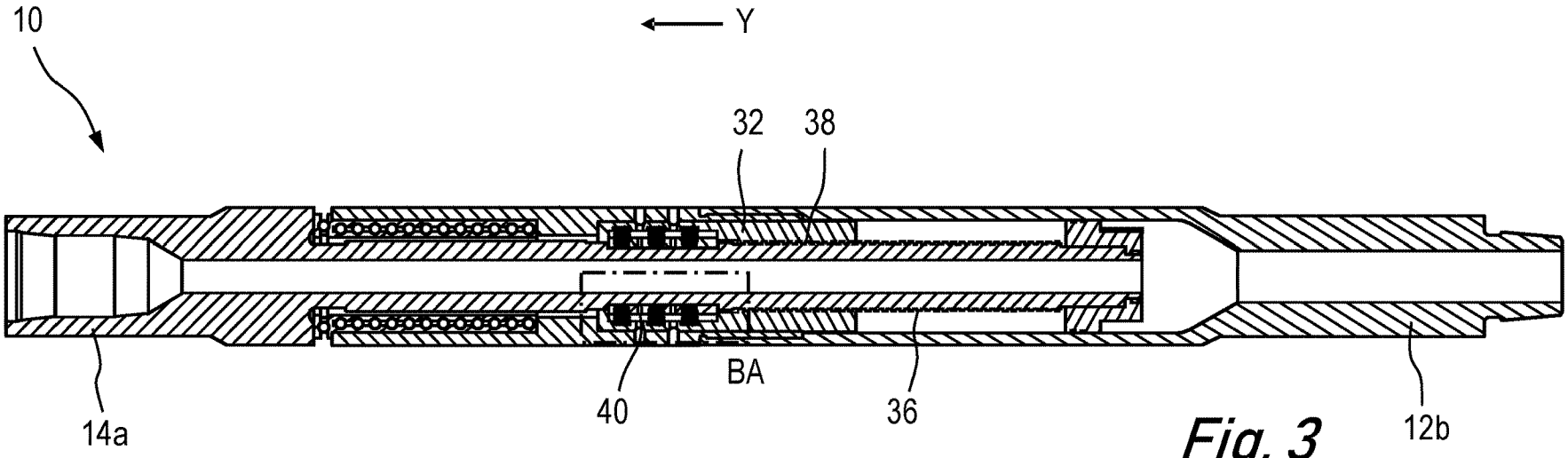
FIG. 3 is a sectional view through the swivel tool of FIG. 2 in a locked configuration.

An upward tension or force is applied to the mandrel by mechanical manipulation of the drill string from surface to axially move the mandrel 14 from a first mandrel position shown in FIG. 1 to a second mandrel position shown in FIG. 2. In the second mandrel position the lock member 32 is received in the recess section 30 of the body 12. The recess 30 and lock member 32 have corresponding hex shapes such that the lock member 32 is engaged in the hex recess 30 and is no longer free to rotate in the bore 21 of the tool body 12 as the mandrel 14 rotates. At this stage the tool is not locked and the mandrel may be moved back to the first mandrel position shown in FIG. 1 by applying a compression force on the string.

Tension ranging from hundreds to several thousands of pounds force is required to stroke the mandrel to the second mandrel position shown in FIG. 2. If the tension applied is too high it will not be possible to rotate the mandrel to lock the tool.

To lock the tool, the mandrel 14 is rotated in a right-hand direction under tension such that the lock member 32 threadably engages the threads 36 on the mandrel 14 moving the lock member 32 along the mandrel in an axially direction shown as arrow "Y" until the latch member 42 on the lock member 32 is aligned with the latch recess 50 on the mandrel surface.

Once the latch member 42 is fully aligned with the latch recess 50 the dog assembly 40 latches the body 12 to the mandrel 14. The mandrel and the tool body are permanently rotationally locked together such that further rotation of the mandrel 14 under compression or tension rotates the body 12. The mandrel and tool body are permanently rotationally coupled where rotation of the drill string rotates the mandrel, tool body and liner and/or sand screen apparatus.

The tool has a pre-determined number of right-hand turns required to move the lock member 32 along the mandrel until the latch member 42 engages the latch recess and permanently locks the tool to rotationally couple mandrel and tool body. This ensures that the tool is not accidentally locked during run-in. In one embodiment, the drill string connected to the mandrel must be right-hand rotated 25 times under tension to move the lock member 32 along the mandrel until the latch member 42 engages the latch recess.

Until the latch member 42 engages the latch recess the tool may be reset to the run-in position by left-hand rotating the mandrel to move the lock member 32 along the mandrel away from the latch recess. In the event that the mandrel is right-hand rotated under tension during run-in, the tool may be reset to move the mandrel to the first position shown in FIG. 1 by left-hand rotating the mandrel under tension to move the lock member 32 along the mandrel away from the latch recess and the lock member out of the hex recess.

The pre-determined threshold number of right-hand turns under tension required to permanently lock the tool may be adjustable. In one embodiment 25 right-hand turns are required, however it will be appreciated that the pre-determined threshold number may be set at any number of turns, for example between ten and fifty turns. In one embodiment the pre-determined threshold number may be set at less than 10 turns. In another embodiment the pre-determined threshold number may be set at more than 50 turns.

In an embodiment the mandrel 14 is rotated in a right-hand direction under tension such that the lock member 32 threadably engages the threads 36 on the mandrel 14. However, it will be appreciated that the threads 36 on the mandrel may be a left-hand thread or a right-hand thread and that the mandrel may alternatively be configured to rotate in a left-hand direction under tension to move the lock member 32 in an axially direction shown as arrow "Y" in FIG. 3.

In the locked configuration shown in FIG. 3, the mandrel and tool body are rotationally coupled or locked, and the drill string, swivel tool and the liner or sand screen apparatus may be rotated in tension or in compression.

Throughout the specification, unless the context demands otherwise, the terms 'comprise' or 'include', or variations such as 'comprises' or 'comprising', 'includes' or 'including' will be understood to imply the inclusion of a stated integer or group of integers, but not the exclusion of any other integer or group of integers. Furthermore, relative terms such as", "lower", "upper, upward, downward, "up" "down" and the like are used herein to indicate directions and locations as they apply to the appended drawings and will not be construed as limiting the invention and features thereof to particular arrangements or orientations.

The invention provides a swivel tool for use in a wellbore. The tool comprises a tool body and a mandrel which is axially moveable relative to the tool body. The tool also comprises a lock member moveable between a first position in which the mandrel is rotatably movable relative to tool body and a second position in which the mandrel and a tool body are rotationally coupled. The lock member is configured to move between the first position and second position in response to a mechanical axial force and rotational force on the mandrel.

The present invention obviates or at least mitigates disadvantages of prior art swivel tools. The swivel tool deployed on a drill string allows the drill string above the swivel tool to be rotated independently of the drill string below the tool. Weight may be applied through the tool in compression and it will swivel but allow the pushing force to be applied from the drill string above the tool to be transmitted to the liner or sand screen located below the swivel tool.

The ability to rotate the pipe above the liner or screen in an ERD well reduces drag and overcomes static friction which may allow increased weight to be applied to the drill tool to push the liner and/or sand control screens into the wellbore to a target depth. This may also mitigate helical buckling of the drill string.

The tool may also allow the liner or sand screen to travel through the wellbore without being rotated to avoid the rotational torque damaging the apparatus. The tool may allow the controlled setting of the swivel tool when the running tool is at a target depth in the wellbore. Once the swivel tool is locked the mandrel and tool body are rotationally coupled, the tool can be rotated in tension or in compression as required. The mechanical actuation of the tool does not affect the actuation or release of the running tool.

The swivel tool may be locked independently of the actuation of the downhole assembly such as a liner or screen assembly. An advantage of mechanically locking the swivel tool is that it may be locked before, after or during the setting of the liner or sand screen apparatus. The tool may allow the rotation of the drill string only above the swivel tool during run-in to get to TD. Once at TD the swivel tool may be locked to rotationally couple the drill string above and below the swivel tool and the liner or sand screen may be subsequently set. Alternatively, the liner or sand screen may be set before the swivel tool is locked.

The swivel tool may be locked to rotationally couple the drill string above and below the swivel tool before the liner or screen assembly reaches TD. This may be advantageous in ERD wells where it may be difficult to reach the desired depth and may allow the whole string to be rotated to reach the desired depth. Once at TD the liner or screen assembly may be hydraulically set.

The swivel tool may be reliably mechanically set by mechanical manipulation of the drill string and does not rely on a hydraulically system or require a ball or dart landing on a seat to create pressure differential to lock the tool. This avoids the internal diameter of the tool being blocked or restricted by a ball or dart.

The present invention may simplify the installation of downhole apparatus as there is no need to open the drill string at any time to drop a device such as a ball or dart to lock the tool. In addition, tool actuation does not rely on a hydraulic system which allows the tool to remain unset and the throughbore to remain unrestricted while performing downhole operations requiring hydraulically operated tools.

The swivel may also facilitate the release of downhole running tools. Running tools may have an emergency release mechanism that require rotation of the downhole string in the event that the primary hydraulic release system fails.

This tool may mitigate or eliminate the need for heavy weight pipe or drill collars. The tool may also reduce the need for multiple roller bearing subs in the drill string and mitigate health and safety risk compared to handling multiple tools.

The foregoing description of the invention has been presented for the purposes of illustration and description and is not intended to be exhaustive or to limit the invention to the precise form disclosed. The described embodiments were chosen and described in order to best explain the principles of the invention and its practical application to thereby enable others skilled in the art to best utilise the invention in various embodiments and with various modifications as are suited to the particular use contemplated. Therefore, further modifications or improvements may be incorporated without departing from the scope of the invention herein intended.

The invention claimed is:

1. A swivel tool for use in a wellbore comprising:

a tool body connectable to a lower drill string;

a mandrel connectable to an upper drill string, the mandrel being movably mounted to the tool body and which is axially moveable relative to the tool body;

and a lock member moveable between a first condition in which the mandrel is rotatably movable relative to the tool body and where the mandrel is movably mounted to the tool body and a second condition in which the mandrel and the tool body are rotationally coupled;

wherein the lock member is configured to move axially along the mandrel between the first condition and second condition in response to rotation of the mandrel one or more times under a mechanical axial force in a first direction to move the lock member axially along the mandrel surface towards the lock member second condition, and wherein, when the lock member is in the first condition, the mandrel and the upper drill string are configured to rotate relative to the tool body and the lower drill string.

2. The swivel tool according to claim 1 wherein the tool body is connectable to a downhole apparatus and/or to a downhole string.

3. The swivel tool according to claim 1 wherein the swivel tool is connectable to a drill string above a liner and/or to a drill string above a sand screen apparatus.

4. The swivel tool according to claim 1 wherein the lock member is configured to move between the first condition and second condition in response to tension and right-hand rotation of the mandrel or in response to tension and left-hand rotation of the mandrel.

5. The swivel tool according to claim 1 wherein the swivel tool is configured to be locked by mechanical manipulation of the mandrel or a downhole string connected to the mandrel.

6. The swivel tool according to claim 1 comprising a bearing member wherein the bearing member is located between an inner surface of the tool body and an outer surface of the mandrel, and wherein the bearing member is configured to allow the rotation of the mandrel relative to the tool body.

7. The swivel tool according to claim 1 wherein the tool body has a recess section on its inner surface wherein the recess section is shaped and/or dimensioned to receive the lock member.

8. The swivel tool according to claim 7 wherein the recess section is a hex-shaped recess and the lock member is a corresponding hex shape configured to engage the hex recess section.

9. The swivel tool according to claim 7 wherein the lock member is configured to move into the recess section in response to a mechanical axial force on the mandrel.

10. The swivel tool according to claim 1 wherein the mandrel comprises threads formed on a section of its outer surface, wherein the lock member has a threaded bore which is configured to be threadably mounted on the mandrel.

11. The swivel tool according to claim 10 wherein threads on the mandrel are configured to engage the threaded bore of the lock member when a mechanical axial force and rotational force is applied to the mandrel.

12. The swivel tool according to claim 1 wherein the mandrel is configured to be rotated under tension to move the lock member axially along the mandrel surface.

13. The swivel tool according to claim 1 comprising a dog assembly, wherein the dog assembly is located in or as part of the locking member and wherein the locking dog assembly comprises a latch member.

14. The swivel tool according to claim 13 wherein the mandrel comprises a latch recess on its outer surface, wherein the latch member is configured to be fully received in the recess before the locking dog assembly latches.

15. The swivel tool according to claim 14 wherein the latch recess and/or the latch member is configured to prevent axial movement of the mandrel relative to the tool body when the latch member is located in the latch recess.

16. A system for setting a liner and/or a sand screen in a wellbore, the system comprising a downhole string, a liner and/or a sand screen and a swivel tool;

wherein the swivel tool is connected in the downhole string above the liner and/or sand screen, and the swivel tool comprises:

a tool body connectable to a lower portion of the downhole string;

a mandrel connectable to an upper portion of the downhole string, the mandrel being movably mounted to the tool body and axially moveable relative to the tool body;

and a lock member moveable between a first position in which the mandrel is rotatably movable relative to the tool body and where the mandrel is movably mounted to the tool body and a second position in which the mandrel and the tool body are rotationally coupled;

wherein the lock member is configured to move axially along the mandrel between the first position and second position in response to rotation of the mandrel one or more times under a mechanical axial force in a first direction to move the lock member axially along the mandrel surface towards the lock member second condition, and wherein, when the lock member is in the first condition, the mandrel and the upper portion of the downhole string are configured to rotate relative to the tool body and the lower portion of the downhole string.

17. A method of running a downhole apparatus into a wellbore, the method comprising:

providing a downhole string connected to a downhole apparatus;

providing a swivel tool on the downhole string above the downhole apparatus, the swivel tool comprising a tool body connectable to a lower portion of the downhole string, a mandrel connectable to an upper portion of the downhole string, the mandrel being movably mounted to the tool body and which is axially moveable relative to the tool body, and a lock member;

after providing the swivel tool on the downhole string, running the downhole string, swivel tool and downhole apparatus into the wellbore while the lock member is in a first condition and the swivel is operational to enable rotation of the mandrel relative to the tool body, wherein, when the lock member is in the first condition, the mandrel and the upper portion of the downhole string are configured to rotate relative to the tool body and the lower portion of the downhole string;

after running the downhole string, swivel tool and downhole apparatus into the wellbore, rotating the downhole string one or more times under a mechanical axial force in a first direction to move the lock member axially along the mandrel surface towards a lock member second condition in which the mandrel and the tool body are rotationally coupled to rotationally lock the swivel tool; and after applying the mechanical axial force and rotational force and rotationally locking the swivel tool, rotating the downhole string and the downhole apparatus in the wellbore.

18. The method according to claim 17 comprising rotating the downhole string with the lock member in the first condition in which the mandrel is rotatably movable relative to tool body such that downhole string rotates but the downhole apparatus is not rotated.

19. The method according to claim 17 comprising applying a mechanical axial force and rotational force to the downhole string to move the lock member between a first condition in which the mandrel is rotatably movable relative to tool body and a second condition in which the mandrel and a tool body are rotationally coupled.

20. The method according to claim 17 comprising applying a mechanical axial force to the downhole string by providing tension, pulling force or an upward force on the downhole string.

21. The method according to claim 17 wherein rotating the mandrel one or more times in the first direction is configured to engage a threaded bore of the lock member.

22. The method according to claim 17 comprising rotating the mandrel approximately twenty-five times under tension in a first direction.

23. The method according claim 17 comprising latching the lock member at the second position to lock the mandrel and a tool body in a rotationally coupled configuration.

24. The method according to claim 17 wherein the downhole apparatus is a liner or a sand screen apparatus.

* * * * *